US007584575B2

(12) United States Patent
Hallberg

(10) Patent No.: US 7,584,575 B2
(45) Date of Patent: Sep. 8, 2009

(54) VARIABLE HEIGHT FOLD AND ROLL STAGING AND METHOD OF ASSEMBLING SAME

(75) Inventor: Edwin A. Hallberg, Midland, MI (US)

(73) Assignee: Stageright Corporation, Clare, MI (US)

( * ) Notice: Subject to any disclaimer, the term of this patent is extended or adjusted under 35 U.S.C. 154(b) by 677 days.

(21) Appl. No.: 10/622,603

(22) Filed: Jul. 18, 2003

(65) Prior Publication Data

US 2005/0011135 A1 Jan. 20, 2005

(51) Int. Cl.
*E04H 3/28* (2006.01)
*A47B 3/00* (2006.01)

(52) U.S. Cl. ..... 52/7; 108/115

(58) Field of Classification Search ..... 52/7, 52/8, 9; 108/115, 124, 167, 168, 169, 171, 108/176, 172, 174, 170; 16/18
See application file for complete search history.

(56) References Cited

U.S. PATENT DOCUMENTS 2,771,937 A * 11/1956 Wilson ..... 297/158.4
2,978,754 A * 4/1961 Wilson ..... 108/170
3,080,833 A * 3/1963 Risdall ..... 108/169
3,351,029 A * 11/1967 Bue ..... 108/170
3,999,491 A * 12/1976 Wilson ..... 108/175
4,054,096 A * 10/1977 Wilson et al. ..... 108/169
4,327,650 A * 5/1982 Bue ..... 108/175
4,779,542 A 10/1988 Staten et al.
4,949,649 A * 8/1990 Terres et al. ..... 108/116
5,349,789 A 9/1994 Andert et al.
5,613,450 A * 3/1997 Wagner et al. ..... 108/175
6,014,936 A 1/2000 Rogers et al.
6,070,367 A * 6/2000 Wagner et al. ..... 52/7
6,082,051 A * 7/2000 Burton et al. ..... 52/7
6,164,016 A * 12/2000 Bue et al. ..... 52/7

FOREIGN PATENT DOCUMENTS

DE 29 18 646 A1 11/1980
DE 41 20 711 C1 4/1992

OTHER PUBLICATIONS

SICO folding stages advertisements (2 pages).

* cited by examiner

*Primary Examiner*—Richard E Chilcot, Jr.
*Assistant Examiner*—Chi Q Nguyen
(74) *Attorney, Agent, or Firm*—Carlson, Gaskey & Olds PC

(57) ABSTRACT

A portable staging assembly having a first platform panel pivotally connected to a second platform panel with the second platform panel further being pivotally connected to a base assembly. When the first and second platform panels are in a position for use substantially parallel to a ground surface, the second platform panel is supported by a plurality of ground engaging supports and the first platform panel is supported by at least one ground engaging support and by the second platform panel. The invention further provides a method of assembling the portable staging assembly.

22 Claims, 5 Drawing Sheets

VARIABLE HEIGHT FOLD AND ROLL STAGING AND METHOD OF ASSEMBLING SAME

BACKGROUND OF THE INVENTION

1. Field of the Invention

The present invention generally relates to portable equipment for forming a staging platform. In particular, the present invention is directed to a portable platform assembly having a first platform panel pivotally connected to a second platform panel and with the second platform panel pivotally connected to a base assembly. When assembled as a staging platform, the first platform panel has at least one ground engaging support and also is supported by the second platform panel which is supported by its own ground engaging supports. All ground engaging supports may provide a single platform height or may be adjustable in length to attain various platform heights. The portable platform assembly is capable of use alone or together with similar assemblies to create a larger staging platform. In general, this type of staging equipment is referred to as fold and roll staging because it has a position for use, where it is substantially parallel to a ground surface, and may be folded to an upright position for storage, where the platform panels are substantially perpendicular to the ground surface and the assembly may be moved on a base having wheels. The present invention further includes a method of assembling the portable platform assembly for use as a staging platform.

2. Discussion of the Prior Art

Portable platform assemblies are widely used, such as for staging equipment in auditoriums, gymnasiums, and event halls to accommodate performers or spectators on an as-needed basis. Depending on the intended use, a facility may require such equipment to be moved between use and storage positions on a repeated basis. Despite the frequent need for staging in their activities, many organizations do not have access to facilities with permanent staging platforms. Because of the temporary nature of the staging used by some organizations, it is desirable to have staging that is, among other desirable properties, easy to set-up, stable during use, easy to transport, and easy to store. However, portable staging having two platform panels typically has the same type and number of ground engaging supports to support each of the platform panels when in use, with each of the panels also connected to a base having wheels. Unfortunately, it is common for these assemblies to be constructed in a way whereby when one attempts to lower a first platform panel onto its ground engaging supports, the second panel is toppled from its upright position, and unless restrained by personnel, will fall toward the ground. Thus, set-up of prior art fold and roll portable staging is not intuitive and may be awkward.

Manufacturers often incorporate wheels on such equipment, usually of the caster type, for use in moving the equipment from a storage location to a position for use as a platform. Sometimes each wheel has a break mechanism to park the equipment in one position for use.

In addition, portable staging often is made to have only a single platform height. Therefore, it also is desirable to have staging that may provide a single height, or that is adjustable to more than one height, thereby eliminating the need for having multiple units each capable of forming only a single stage height.

In view of the above, there remains a need for staging that is easy to transport and store, is simple and intuitive to assemble, and stable during storage, assembly and use. It also is desirable to have portable staging that has the added benefit of being adjustable to a variety of platform heights. Ease of set-up may reduce the number of personnel needed to assemble a platform and increase safety, while greater flexibility in height increases the number and variety of performances that can be executed using the same portable staging assemblies.

SUMMARY OF THE INVENTION

The purpose and advantages of the invention will be set forth in and apparent from the description and drawings that follow, as well as will be learned by practice of the invention.

The present invention is generally embodied in a portable staging assembly. In a first aspect, the invention provides a portable staging assembly having a first platform panel pivotally connected to a second platform panel. The second platform panel further is pivotally connected to a base assembly. When the first and second platform panels are in position for use substantially parallel to a ground surface, the second platform panel is supported by a plurality of ground engaging supports and the first platform panel is supported by at least one ground engaging support and by the second platform panel. In another aspect of the invention, all of the ground engaging supports are adjustable in length to provide variable height staging.

By placing the at least one ground engaging support for the first platform panel at a distance from the pivotal connection between the first and second platform panels, the first platform panel may be pivoted to a position at an acute angle or parallel to the ground surface without causing the base assembly or second platform panel to be lifted or otherwise moved relative to the ground surface. Thus, uncontrolled toppling of the second platform panel is avoided and a single person may safely and swiftly form a portable stage. In addition, fewer ground engaging supports may be used for the first platform panel than for the second platform panel because the first platform panel is supported in part by the second platform panel.

The invention also provides a new method of assembling a portable stage. The method includes rolling across a ground surface a portable staging assembly having first and second platform panels pivotally connected to each other with the platform panels in a storage position substantially perpendicular to the ground surface, and further having the second platform panel pivotally connected to a base assembly having wheels. While maintaining the second platform panel in the storage position, the first platform panel is pivoted from the storage position to a position at an acute angle or parallel to the ground surface wherein the first platform panel is supported by at least one ground engaging support connected to the first platform panel and by the second platform panel. The method further involves pivoting the second platform panel to a position substantially parallel to the ground surface to rest on a plurality of ground engaging supports connected to the second platform panel while simultaneously locating the first platform panel in a position substantially parallel to the ground surface.

In another aspect of the method provided, a first platform panel restraint may be disengaged to permit pivoting of the first platform panel from the storage position to the position at an acute angle or parallel to the ground surface. In yet a further aspect of the method, a second platform panel restraint is automatically disengaged when the first platform panel is pivoted to the position at an acute angle or parallel to the ground surface, so as to then permit the second platform panel to be moved to a position substantially parallel to the ground surface.

It is to be understood that both the foregoing general description and the following detailed description are exemplary, provided for purposes of explanation only, and are not restrictive of the invention as claimed. Further features and objects of the present invention will become more fully apparent in the following description of the preferred embodiment and from the appended claims.

BRIEF DESCRIPTION OF THE DRAWINGS

In describing the preferred embodiment, reference is made to the accompanying drawing figures wherein like parts have like reference numerals and wherein.

Figure 1:
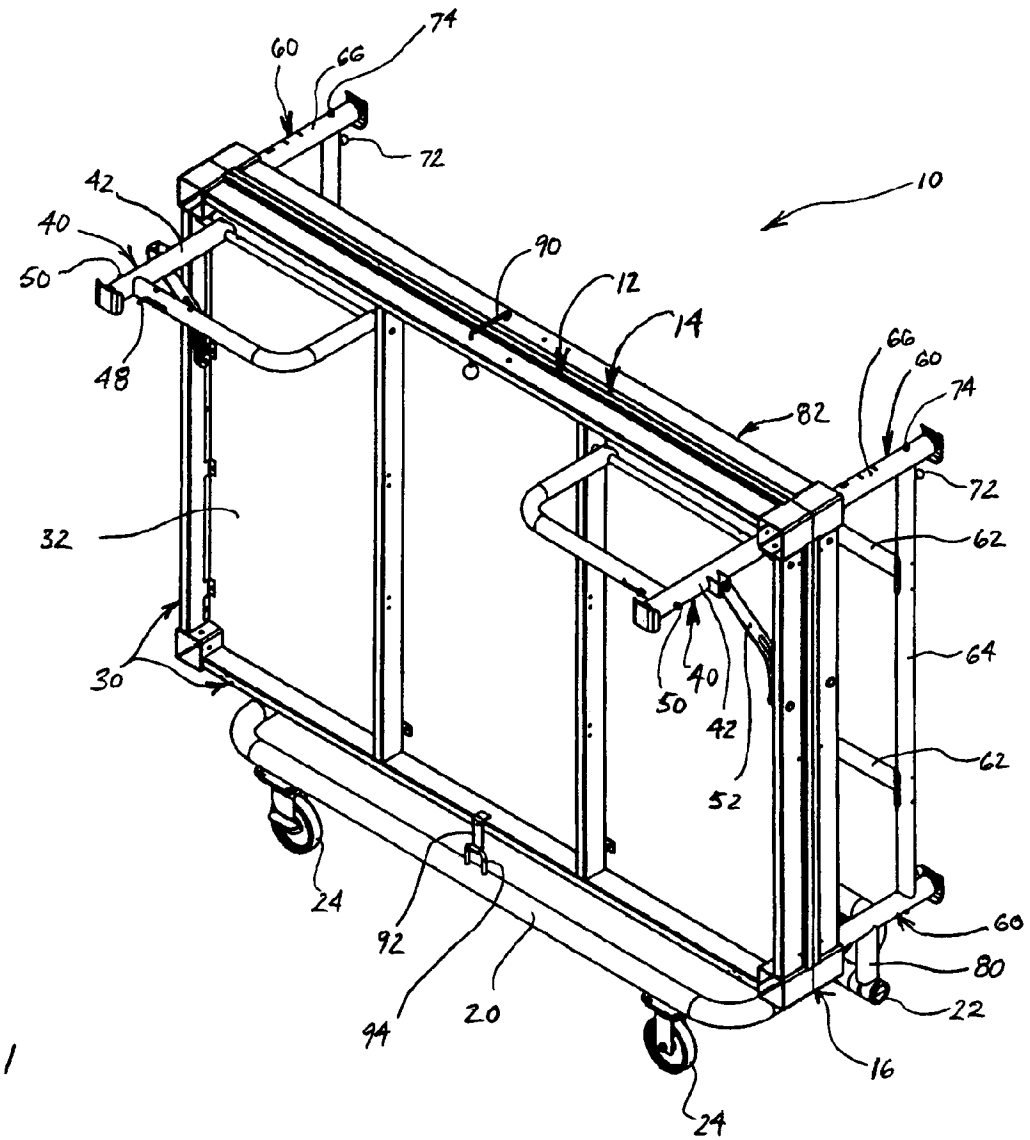
FIG. 1 is a perspective view of a preferred embodiment of a portable staging assembly having first and second platform panels in a storage position substantially perpendicular to a ground surface.

It should be understood that the drawings are not to scale. While considerable mechanical details of the portable staging assembly, including details of fastening means and other plan and section views of the preferred embodiment depicting the invention have been omitted, such details are not per se part of the present invention and are considered well within the comprehension of those skilled in the art in light of the present disclosure. It also should be understood that the present invention is not limited to the preferred embodiment illustrated.

DETAILED DESCRIPTION OF THE PREFERRED EMBODIMENT

Referring generally to FIGS. 1-4 and 5A-5E, it will be appreciated that a portable platform assembly 10 of the present invention generally may be embodied in numerous configurations. The assembly 10 may stand alone, or may be grouped together with similar assemblies to form a larger platform or stage configuration.

The portable platform assembly 10 has a first platform panel 12 pivotally connected to a second platform panel 14 at pivot 16. Second platform panel 14 also is pivotally connected to base 20 at pivot 22. Base 20 has wheels 24 to permit assembly 10 to be easily transported when in a storage position with first and second platform panels 12, 14 in a position substantially perpendicular to the ground surface. Wheels 24 may be of the typical swivel caster type and for safety purposes, wheels 24 may be provided with locking mechanisms by which the swivel caster wheels 24 can be locked to prevent rolling.

First platform panel 12 generally includes an understructure or frame 30 to which is mounted a deck 32. Also connected to first platform panel 12 are ground engaging supports 40, shown as leg structures. Ground engaging supports 40 may be in a fixed position perpendicular to first platform panel 12, or may be capable of being folded to a position parallel to first platform panel 12 for storage, and to a position perpendicular to platform panel 12 for use.

Figure 4:
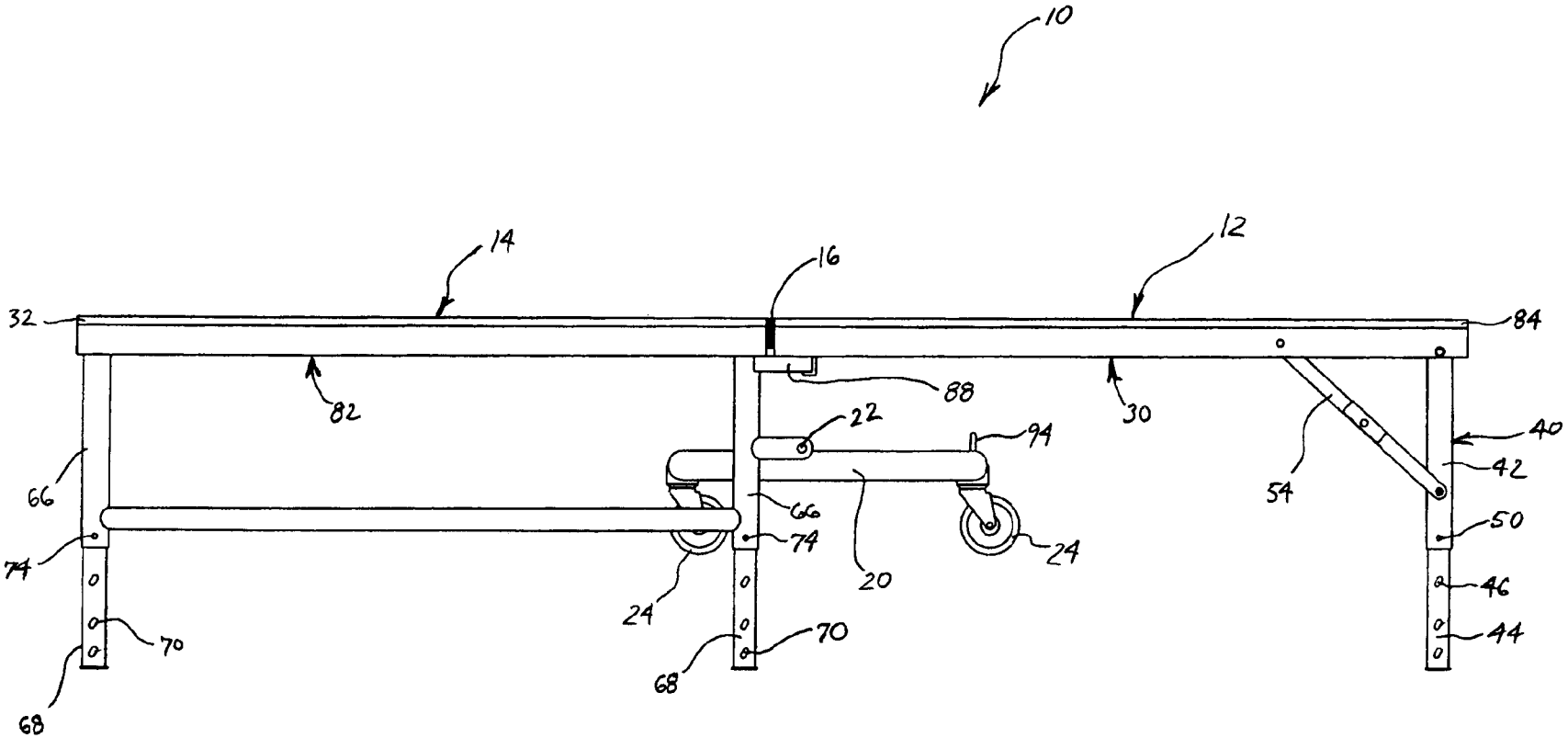
FIG. 4 is a side view of the preferred embodiment in a position for use as in FIG. 3 but having the ground engaging supports extended to provide a raised height staging platform.

As best seen in FIG. 4, ground engaging supports 40 include a first tube 42 and may include a second tube 44 to form a telescopic leg. Second tube 44 further has a series of spaced apart holes 46 therethreough. Second tube 44 may be locked in various height positions by locking mechanism 48. Locking mechanism 48 includes a pin 50 which extends through an outer first tube 42 as well as one of the series of holes 46 through second tube 44. Within the scope of the invention, alternatively well known ground engaging supports or various structures for adjustable telescopic legs may be used. Also, to facilitate a more compact storage configuration, any one of a number of folding structures may be utilized for ground engaging supports 40, such as the sliding gusset 52, shown in FIG. 1, or the folding gusset 54 shown in FIG. 4. Moreover, first platform panel 12 may simply have a single wide ground engaging support spaced from the pivotal connection 16 to second platform panel 14.

Second platform panel 14 has ground engaging supports 60. The ground engaging supports 60 are rigidly fixed to second platform panel 14 and may include further lateral members 62 and longitudinal members 64 to fix ground engaging supports 60 in their relative positions spaced from each other.

Each ground engaging support 60 includes a first tube 66 and may include a second tube 68 to form a telescopic leg. Second tube 68 may include a series of spaced apart holes 70 (shown in FIG. 4) to permit a plurality of platform height settings. The various height of each support may be selected and locked with a locking mechanism 72 that includes a pin 74 which extends through the first tube 66 and second tube 68. Once again, alternative support structures, locking mechanisms or pin structures may be used.

Ground engaging supports 60 that are closest to pivotal connection 16 include members 80 which extend perpendicularly to ground engaging support 60 and terminate in pivotal connection 22 to base 20. The positioning of member 80 along the ground engaging support 60, relative to pivot 22, helps adjust the center of gravity of the assembly, so as to establish a stable feeling of the platform panels 12, 14 when in the upright storage position. Also, the unique structure of the present invention permits both platform panels 12, 14 to be relatively close to the ground surface when in the upright storage position, further enhancing the stability of assembly 10.

Figure 2:
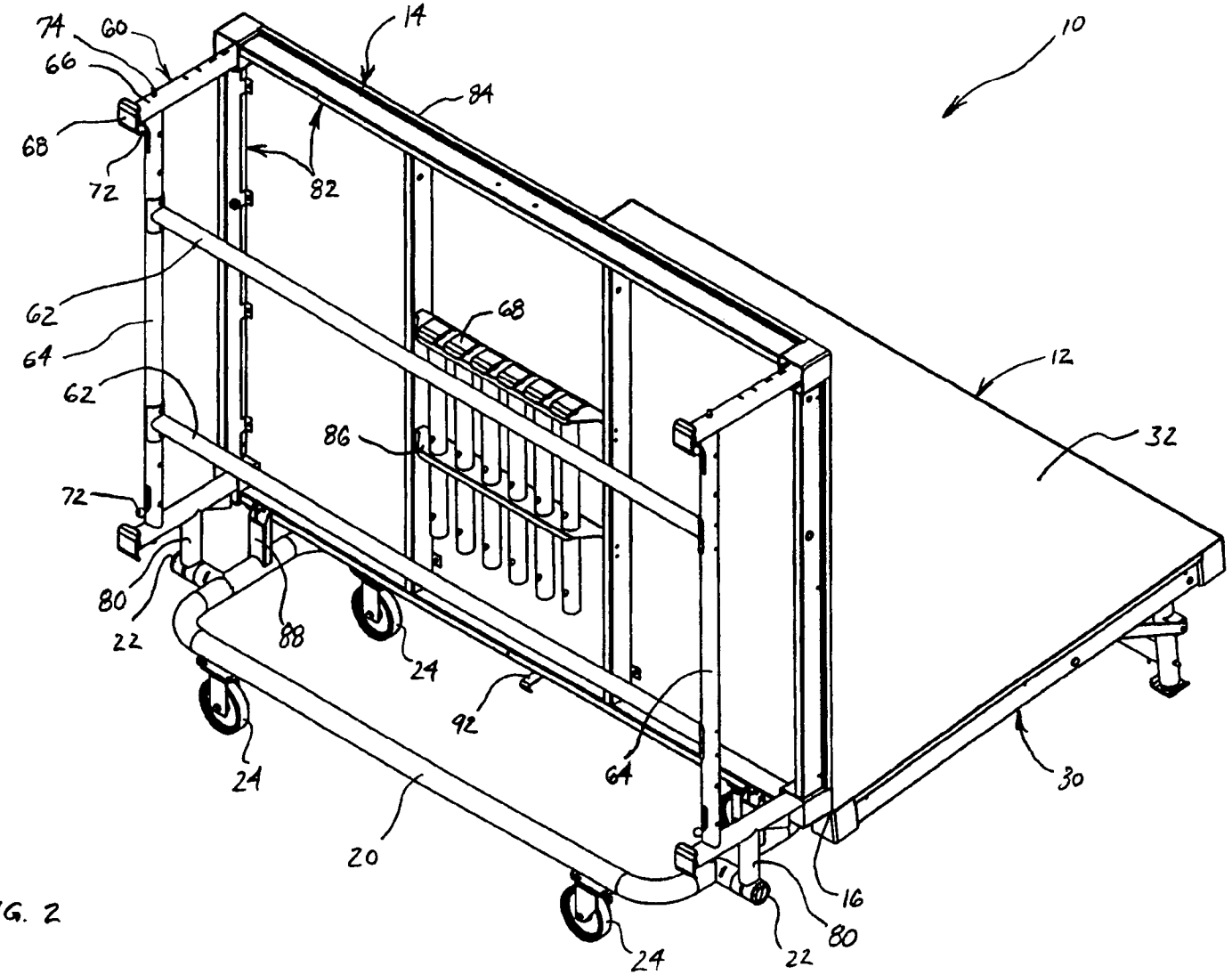
FIG. 2 is a perspective view of the preferred embodiment with a first platform panel pivoted to be supported by a pair of ground engaging supports and by the second platform panel.

Second platform panel 14 generally includes an understructure or frame 82 to which is mounted a deck 84. Mounted adjacent deck 84 and between the structural members of frame 82 is a storage rack 86 for storing the second tubes used in forming the telescopic legs, as shown in FIG. 2.

The pivotal connection 16 between first platform panel 12 and second platform 14 may be constructed in numerous ways. For instance, as shown, the hinge may be of a flexible material type, such as rubber or a woven fabric, with the material affixed to the edge at the inner end of each of the platform panels 12, 14. Similarly, the pivotal connection 16 may be formed by a series of hinges or an elongated piano hinge affixed to each of the platform panels.

One of the advantages of the present invention is that first platform panel 12 may be supported by fewer ground engaging supports than second platform panel 14. This is because first platform panel 12 is supported by at least one ground engaging support 40 along the outer end and by second platform panel 14 along the inner end. Eliminating the ground engaging supports adjacent the inner end of first platform panel 12, allows first platform panel 12 to be lowered toward the ground surface to the position at an acute angle or parallel to the ground surface without the tendency to lift base 20 or topple the remaining upright second platform panel 14.

If pivotal connection 16 is of sufficient strength, pivotal connection 16 may be sufficient to transfer loads from first platform panel 12 to second platform panel 14, and ultimately down through ground engaging supports 60 of second platform panel 14. However, as an added safety feature, or when pivotal connection 16 is not sufficiently strong to support such loads, a support arm 88 may be connected to second platform panel 14 to support the inner end of first platform panel 12 when platform panels 12, 14 are in a position for use, substantially parallel to the ground surface, as shown in FIGS. 4 and 5C-5E. Support arm 88 also is employed as a stop to support second platform panel 14 from pivoting toward first platform panel 12 when platform panels 12, 14 are in the upright storage position. In this manner, second platform panel 14 may not pivot past its upright position, substantially perpendicular to the ground surface.

For added safety, a first restraint 90, best seen in FIG. 1, is used to lock first platform panel 12 to second platform panel 14 when both platform panels are in the storage position, substantially perpendicular to the ground surface. First restraint 90 may be of any type which can temporarily hold the two platform panels close together at their outer ends when in the storage position. As shown in FIG. 1, a second restraint 92 may be employed to prevent platform panels 12, 14 from pivoting toward a use position of second platform panel 14 when platform panels 12, 14 are both still in a storage position. In this embodiment, second restraint 92 is connected to first platform panel 12 and engages base 20 via a catch 94 mounted to base 20. As shown in FIG. 2, once first platform panel 12 has been pivoted toward the ground surface, restraint 92 releases from catch 94 to permit second platform panel 14 to be pivoted toward the use position, parallel to the ground surface.

Figure 5A:
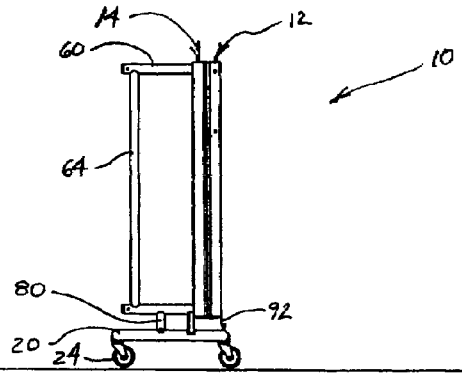
FIGS. 5A-5E are a series of side views showing the first and second platform panels of the preferred embodiment in successive positions between a storage position substantially perpendicular to the ground surface and a position for use wherein the first and second platform panels are substantially parallel to the ground surface.

Now turning to the method of assembling the portable platform assembly 10 of the present invention (best seen in FIGS. 5A-5E), it will be appreciated that when platform panels 12, 14 are in the upright storage position, assembly 10 may be rolled across a ground surface on wheels 24 of base 20. In this manner, assembly 10 may be moved into a desired position for use, as shown in FIG. 5A. To place the assembly in position for use, if so equipped, at least one of swivel caster wheels 24 may be locked to prevent further rolling.

Figure 5B:
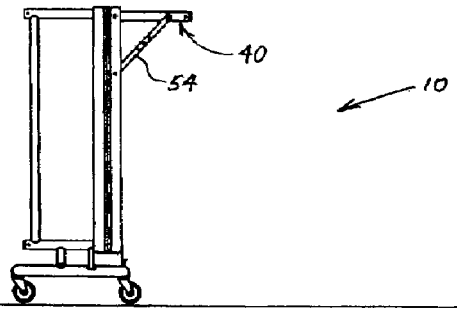

If ground engaging supports 40 on first platform panel 12 are of the folding type, then ground engaging supports 40 are moved to their position for use, perpendicular to first platform panel 12, as shown in FIGS. 1 and 5B. If the assembly 10 is equipped with telescopic legs, then second tubes 44 may be inserted in first tubes 42 of ground engaging supports 40 of first platform panel 12. In a similar manner, second tubes 68 may be inserted in first tubes 66 of ground engaging supports 60 of second platform panel 14. Once the appropriate height for each leg is selected and the leg tube lengths are locked in place, such as by respective pins 50, 74, then first restraint 90 may be unlocked to permit first platform panel 12 to pivot toward a position more parallel to the ground surface.

Figure 3:
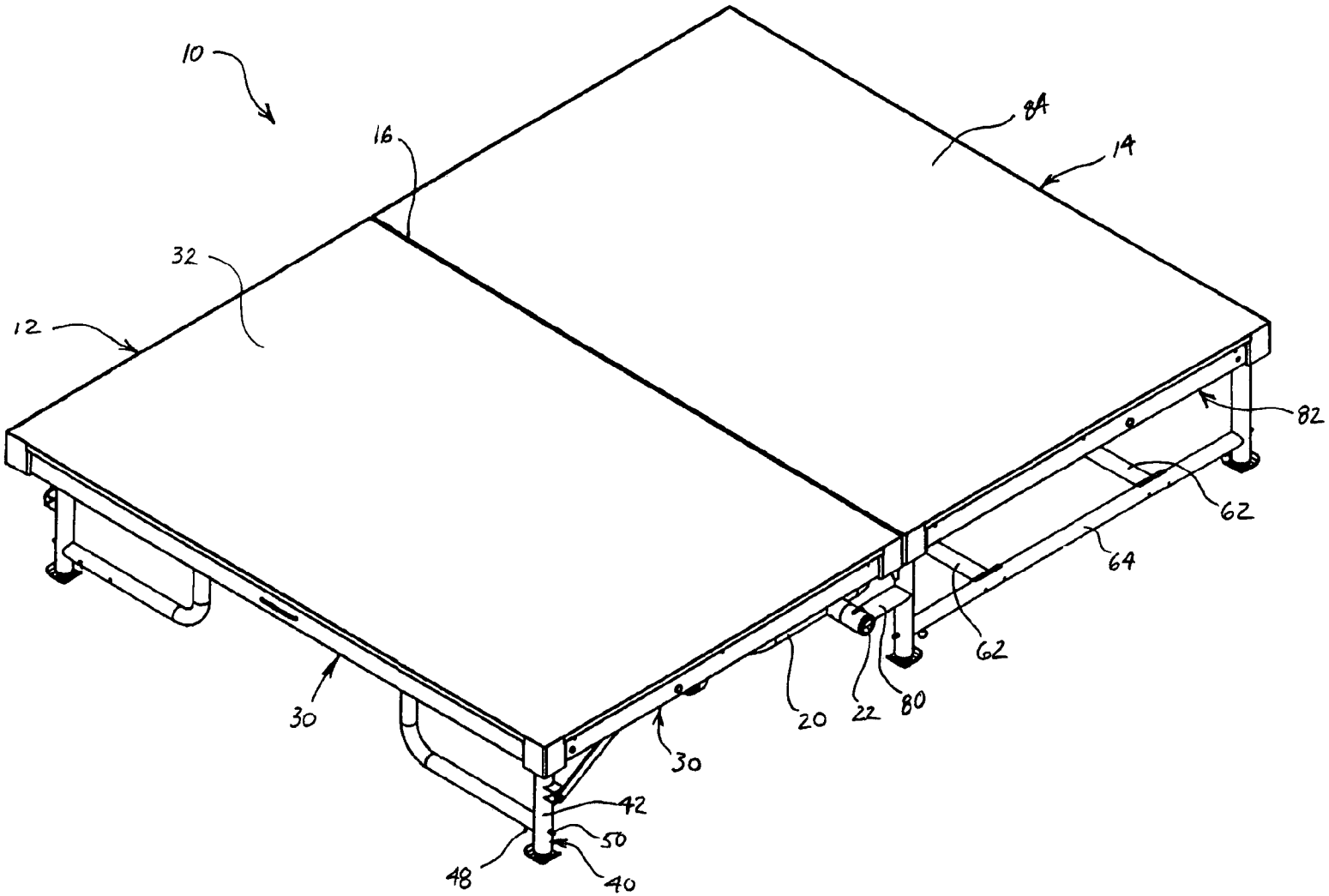
FIG. 3 is a perspective view of the preferred embodiment in a position for use, with both the first and second platform panels positioned substantially parallel to the ground surface and supported by ground engaging supports.
Figure 5C:
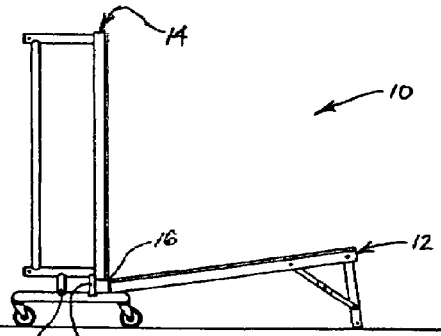
Figure 5D:
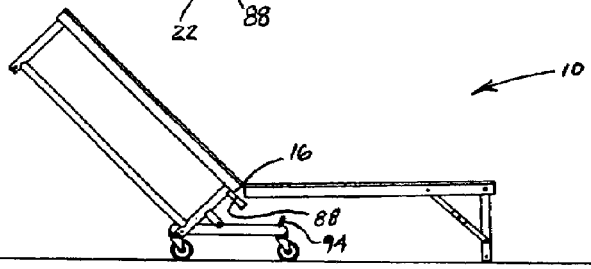
Figure 5E:
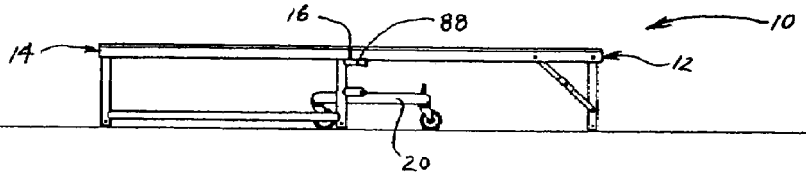

Second platform panel 14 remains in the upright position while first platform panel 12 is pivoted to a position at an acute angle or parallel to the ground surface, where it is supported by at least one ground engaging support 40 at the outer end and by second platform panel 14 at the inner end, as shown in FIGS. 2 and 5C. The pivoting of first platform panel 12 releases second restraint 92 from catch 94 to permit second platform panel 14 to be pivoted toward the ground surface. As second platform panel 14 is pivoted toward the use position on the ground surface, ground engaging supports 60 along the inner end of second platform panel 14 will engage the ground surface first, and pivotal connection 16 at the inner ends of platform panels 12, 14 is raised, as shown in FIG. 5D. Then, as the ground engaging supports 60 along the outer end of second platform panel 14 contact the ground, pivotal connection 16 at the inner end of platform panels 12, 14 is raised until first and second platform panels 12, 14 are in a common plane, substantially parallel to the ground surface, as shown in FIGS. 3, 4 and 5E. Depending on the chosen length of the ground engaging supports 40, 60, the pivoting of second platform panel 14 to a use position may leave wheels 24 of base 20 relatively adjacent the ground surface, such as shown in FIG. 5E, or may lift base 20 more substantially above the ground surface, such as shown in FIG. 4. Once in position for use, platform assembly 10 is effectively parked on ground engaging supports 40, 60.

To move platform assembly 10 to a storage position, the process of assembling platform assembly 10 is reversed. Thus, briefly, platform assembly 14 is pivoted to the upright position, until support arms 88 contact base 20 and platform panel 14 achieves a position substantially perpendicular to the ground surface. This, in turn, brings wheels 24 of base 20 into substantial load-bearing contact with the ground surface. Next, platform panel 12 is pivoted to the upright position. This reengages second restraint 92 on first platform panel 12 with catch 94 on base 20. First restraint 90 is then reengaged to lock first platform panel 12 to second platform panel 14. If desired, respective second tubes 44, 68 of the telescopic leg assemblies may be removed and stored, such as in rack 86. If foldable, ground engaging supports 40 of first platform panel 12 may be folded to a storage position, substantially parallel to platform panel 12. Platform assembly 10 is now ready to be rolled to a position for storage.

It will be appreciated that platform assembly 10 of the present invention may be constructed in various configurations. A variety of materials and shapes of components may be used, and may be joined to each other in any number of conventional manners, such as by welding or with suitable fasteners.

Finally, it should be understood that while a preferred embodiment has been described herein, any variety of fastening means, suitable materials of construction, and dimensions may be used to satisfy the particular needs and requirements of the end user. It will be apparent to those skilled in the art that various modifications and variations can be made in the design and construction of a platform assembly without departing from the scope or spirit of the present invention. Other embodiments of the invention will be apparent to those skilled in the art from consideration of the specification and practice of the invention disclosed therein.

The invention claimed is:

1. A portable staging assembly comprising a first platform panel having an upper surface and a lower surface, said platform panel pivotally connected to a second platform panel having an upper surface and a lower surface, the second platform panel further being pivotally connected to a base assembly wherein when the first and second platform panels are in a position for use substantially coplanar and parallel to a ground surface the upper surface of the first platform panel and the upper surface of the second platform panel face upward and the second platform panel is supported by a plurality of ground engaging supports and the first platform panel is supported by at least one ground engaging support and by the second platform panel, and wherein when the first and second platform panels are pivoted to a storage position substantially perpendicular to the ground surface the respective upper surfaces of the first and second platform panels face one another.

2. The portable staging assembly of claim 1, wherein the first platform panel is adapted to be pivoted from a storage position toward the ground surface while the second platform panel is in a storage position substantially perpendicular to the ground surface.

3. The portable staging assembly of claim 1, further comprising a first platform panel restraint to selectively prevent the first platform panel from pivoting relative to the second platform panel when the first and second platform panels are in the storage position substantially perpendicular to the ground surface.

4. The portable staging assembly of claim 3, wherein the first platform panel restraint also locks the second platform panel in the storage position.

5. The portable staging assembly of claim 4, wherein a second platform panel restraint prevents the second platform panel from being pivoted to a position substantially parallel to the ground surface if the first platform panel is still in the storage position.

6. The portable staging assembly of claim 5, wherein the second platform panel restraint is connected to the first platform panel.

7. The portable staging assembly of claim 6, wherein the second platform panel restraint engages the base assembly.

8. The portable staging assembly of claim 1, wherein the ground engaging supports are adjustable in length.

9. The portable staging assembly of claim 8, wherein the adjustable ground engaging supports comprise telescopic leg assemblies.

10. The portable staging assembly of claim 9, wherein each telescopic leg assembly further comprises a first tube and a second tube that slideably engages the first tube.

11. The portable staging assembly of claim 1, wherein the base assembly further comprises wheels.

12. The portable staging assembly of claim 11, wherein the wheels connected to the base assembly comprise caster type wheels.

13. The portable staging assembly of claim 1, wherein the base assembly further comprises a panel stop to engage the second platform panel and assist in holding the second platform panel in the storage position after the first panel has been pivoted to a position at an acute angle or substantially parallel to the ground surface.

14. The portable staging assembly of claim 1, wherein the first platform panel is pivotally connected directly to the second platform panel.

15. The portable staging assembly of claim 14, wherein the first platform panel is supported by the second platform panel through a pivot.

16. A portable staging assembly comprising a first platform panel having an upper surface and a lower surface, said platform panel pivotally connected to a second platform panel having an upper surface and a lower surface, the second platform panel further being pivotally connected to a base assembly wherein when the first and second platform panels are in a position for use substantially coplanar and parallel to a ground surface the upper surface of the first platform panel and the upper surface of the second platform panel face upward and the second platform panel is supported by a plurality of ground engaging supports and the first platform panel is supported by at least one ground engaging support and by the second platform panel, wherein when the first and second platform panels are pivoted to a storage position substantially perpendicular to the ground surface the respective upper surfaces of the first and second platform panels face one another, wherein the ground engaging supports are adjustable in length, wherein the adjustable ground engaging supports comprised telescopic leg assemblies, wherein each telescopic leg assembly further comprises a first tube and a second tube that slideably engages the first tube; and a storage rack to hold the second tube of each telescopic leg assembly when in a storage position.

17. A method of assembling a portable stage comprising the steps of:

rolling across a ground surface a portable staging assembly having first and second platform panels, said platform panels each having an upper surface and a lower surface, said platform panels pivotally connected to each other with the platform panels in a storage position substantially perpendicular to the ground surface wherein the respective upper surfaces of the platform panels face one another, and further having the second platform panel pivotally connected to a base assembly having wheels, while maintaining the second platform panel in the storage position, pivoting the firs platform panel from the storage position to a position at an acute angle or parallel to the ground surface wherein the first platform panel is supported in part by at least one ground engaging support connected to the first platform panel, and pivoting the second platform panel to a position substantially parallel to the ground surface wherein it is supported by a plurality of ground engaging supports connected to the second platform panel while simultaneously locating the first platform panel in a position substantially parallel to the ground surface wherein the first platform panel is supported by the at least one ground support connected to the first platform panel and by the second platform panel and the respective upper surfaces of the platform panels face upward.

18. The method of claim 17, further comprising the step of moving the at least one ground engaging support connected to the first platform panel from a storage position substantially parallel to the first platform panel to a use position to provide support in a direction perpendicular to the first platform panel prior to pivoting the first platform panel to a position at an acute angle or parallel to the ground surface.

19. The method of claim 17, further comprising the step of adjusting the length of the plurality of ground engaging supports connected to the second platform panel to be of comparable length to the at least one ground engaging support connected to the first platform panel prior to pivoting the second platform panel to a position substantially parallel to the ground surface.

20. The method of claim 17, further comprising the step of disengaging a first platform panel restraint prior to pivoting the first platform panel from the storage position to the position at an acute angle or parallel to the ground surface.

21. The method of claim 20, further comprising the step of automatically disengaging a second platform panel restraint when the first platform panel is pivoted to the position at an acute angle or parallel to the ground surface, permitting the second platform panel to be pivoted to a position substantially parallel to the ground surface.

22. The method of claim 17, further comprising the step of automatically lifting the base assembly from the ground surface as the second platform panel is pivoted to a position substantially parallel to the ground surface.

* * * * *

UNITED STATES PATENT AND TRADEMARK OFFICE

CERTIFICATE OF CORRECTION

PATENT NO. : 7,584,575 B2
APPLICATION NO. : 10/622603
DATED : September 8, 2009
INVENTOR(S) : Edwin A. Hallberg It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 613 days.

Signed and Sealed this

Fourteenth Day of September, 2010

David J. Kappos

David J. Kappos
*Director of the United States Patent and Trademark Office*